US005353968A

United States Patent [19]

Good, Jr.

[11] Patent Number: 5,353,968

[45] Date of Patent: Oct. 11, 1994

[54] FLEXIBLE LIQUID CONTAINER WITH SPILL PREVENTING SQUEEZE OPENABLE SEAL

[76] Inventor: James L. Good, Jr., Rte. 1, Box 428-55, Stoneville, N.C. 27048

[21] Appl. No.: 922,217

[22] Filed: Jul. 30, 1992

[51] Int. Cl.[5] ..... B65D 47/10

[52] U.S. Cl. ..... 222/212; 222/541

[58] Field of Search ..... 222/212, 491, 494, 541; 215/253, 260, 306, 232, 250, 344, 350, 354; 141/11, 69; 184/1-5

[56] References Cited

U.S. PATENT DOCUMENTS

| | | | |
|---|---|---|---|
| 882,287 | 3/1908 | Behr | 215/263 |
| 2,030,618 | 8/1935 | Whitney | 215/263 |
| 3,029,987 | 4/1982 | Gronemeyer | 222/541 |
| 3,186,606 | 6/1965 | Williams | 215/253 |
| 4,269,330 | 5/1981 | Johnson | 222/541 |
| 4,712,700 | 12/1987 | Fischman | 215/366 |
| 4,789,082 | 12/1988 | Sampson | 222/541 |
| 4,938,390 | 7/1990 | Markva | 222/541 |
| 4,949,857 | 8/1990 | Russell | 222/541 |
| 5,044,531 | 9/1991 | Rhodes, Jr. | 222/541 |
| 5,071,017 | 12/1991 | Stull | 215/260 |

*Primary Examiner*—Andres Kashnikow
*Assistant Examiner*—Philippe Derakshani
*Attorney, Agent, or Firm*—Quarles & Brady

[57] ABSTRACT

A container with flexible walls has bonded to it a closure which is scored, perforated, narrowed or otherwise weakened in selected patterns such that the closure will substantially retain the liquid in the container while the container is rotated to a pouring position. However, the closure will irreversibly fail and thereby release the liquid when the user squeezes the bottle while in the pouring position.

12 Claims, 1 Drawing Sheet

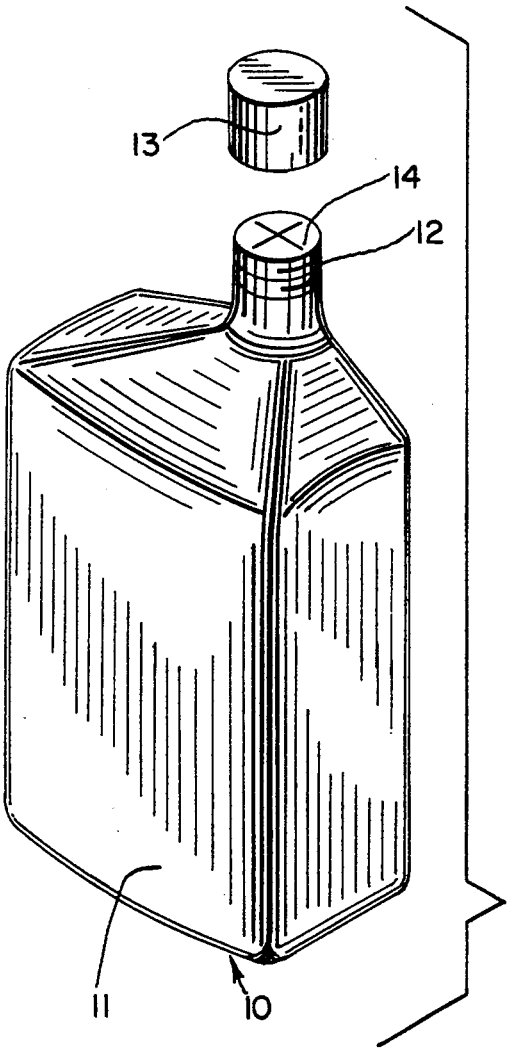
FIG. 1
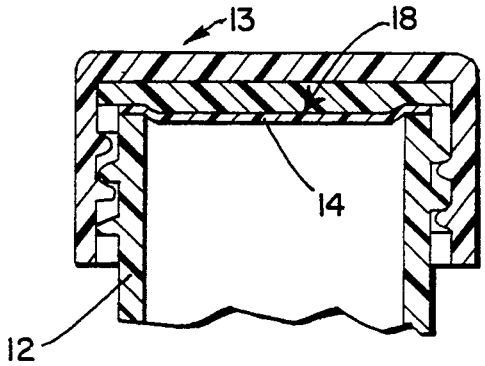
FIG. 2
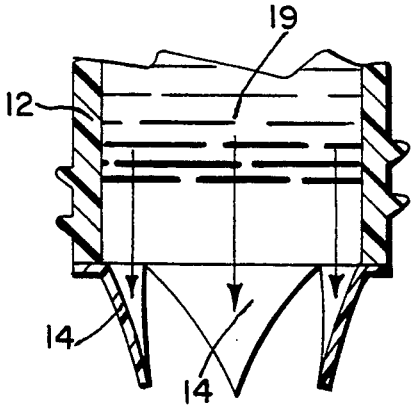
FIG. 3
FIG. 4
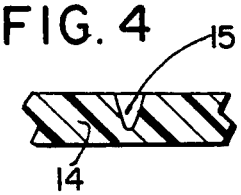
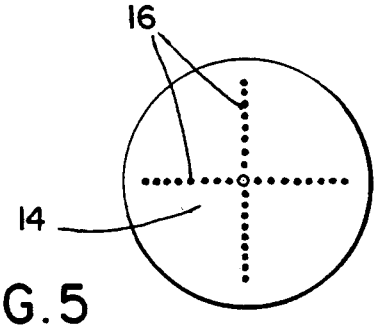
FIG. 5
FIG. 6
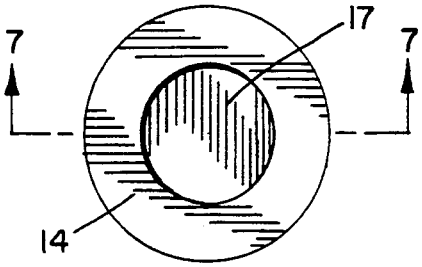
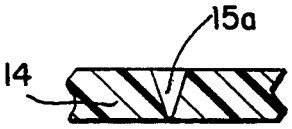
FIG. 8
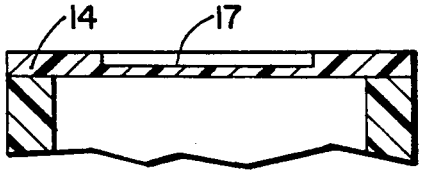
FIG. 7

FLEXIBLE LIQUID CONTAINER WITH SPILL PREVENTING SQUEEZE OPENABLE SEAL

BACKGROUND OF THE INVENTION

1. Field Of The Invention

This invention relates to flexible hand held liquid (e.g., motor oil) containers which are inverted to pour their contents into an aperture of a receptacle, such as an engine crankcase.

2. Background Information

Motor oil, engine additives and other liquids in the automotive and other industries are usefully packaged in flexible plastic bottles. To dispense the liquid, the user removes the bottle cap, inverts the bottle and inserts the mouth and neck of the bottle into an aperture of the receptacle of the product. During this process, liquid frequently begins pouring from the bottle's mouth before its insertion into the aperture, resulting in spillage. One common instance of this problem occurs in adding oil to an engine. The crowded and cramped space makes if difficult to insert the bottle's mouth into the crankcase opening quickly. As a result, oil spills and eventually runs onto the user's garage floor or driveway.

SUMMARY OF THE INVENTION

The invention provides a container used for pouring liquid into an aperture. The container is a flexible chamber having a mouth with a lip which can be sealed by a closure. The closure comprises a membrane which has a rim on its perimeter and an inner portion which has lines or areas of relative weakness on its surface. The closure is bonded to the rim of the container after it has been suitably filled with liquid. Despite the weakening, the closure is strong enough to retain the liquid as the container is rotated into a pouring position, but is sufficiently weak that the closure fails and tears open at the points of weakness when the user squeezes the container, thus releasing the liquid into the aperture.

Thus, an object of the invention is to provide a container which enables its user to pour its liquid contents into a relatively small aperture without spilling the liquid in the process. This will avoid unnecessary waste of resources and prevent contamination of surrounding areas, such as the user's garage or driveway.

These and other objects and advantages of the invention will be apparent from the description to follow. In the description, preferred embodiments will be described with reference to the accompanying drawings. These embodiments do not necessarily represent the full scope of the invention, however, and the invention may be incorporated in other embodiments. Therefore, reference should be made to the claims herein for interpreting the breadth of the invention.

BRIEF DESCRIPTION OF THE DRAWINGS

FIG. 1 is a perspective view of a container, such as a bottle of oil, embodying the present invention.

FIG. 2 is an enlarged cross-sectional view of the mouth of the container of FIG. 1, to which has been attached a closure embodying the present invention and a cap threaded to the container's mouth.

FIG. 3 is an enlarged and partially schematic view of the mouth of the container of FIG. 1 which has been inverted; it shows the failure of the closure of the present invention upon the squeezing of the container.

FIG. 4 is an elevational view of a cross-section of a portion of a scored-line closure embodying the present invention.

FIG. 5 is a top plan view of a perforated closure.

FIG. 6 is a top plan view of a closure having a thinned inner portion.

FIG. 7 is a cross-sectional view taken on line 7—7 of FIG. 6.

FIG. 8 is an elevational view of a cross-section of a portion of a closure embodying the present invention which has a score which slightly penetrates its lower surface.

DESCRIPTION OF THE PREFERRED EMBODIMENTS

FIG. 1 shows a typical plastic container in which a consumer purchases a quart of motor oil.

The container 10 has one or more flexible walls 11, a threaded mouth 12 and a threaded cap 13. Bonded to the lip of mouth 12 is a closure 14 embodying the present invention.

Closure 14 may be made of any of several materials used in seals commonly found protecting the contents of containers of milk, cleaning fluids and other liquids. If used on a container of engine oil, closure 14 may be made of a polyurethane or polyethylene having low temperature characteristics so that any pieces carried into the crankcase would dissolve in the heated oil. Closure 14 may be bonded to the lip of mouth 12 by adhesive, pressure, heat or any combination of them and other methods which are commonly used to seal containers.

FIGS. 4 through 8 illustrate several embodiments of closure 14. The embodiment of FIG. 4 has one or more scores 15 in top of closure 14. In the embodiment of FIG. 4, the score 15*a* slightly penetrates the lower surface of closure 14, i.e., it is a slit. Such a score may be made by any number of methods which will be evident to those skilled in the art, including creasing, partial cutting and laser cutting. In FIG. 5, closure 14 has one or more series of perforations which may be made by any of the commonly used perforating means. The size and spacing of the perforations 16 must be such that surface tension and other effects will retain substantially all of the liquid in an inverted container 10 until walls 11 are squeezed. In the embodiment of FIGS. 6 and 7, closure 14 is provided with a thinned central area 17. Thinned area 17 may be formed by compression during the manufacture of closure 14, by subsequent boring of closure 14 or by any other suitable means.

The most appropriate design of a particular closure 14 depends upon the size of container 10 and the density and viscosity of the liquid which it contains. The design requirements are that the closure (a) will retain substantially all of the liquid in the container when it is held unsqueezed in a position in which closure 14 is subject to the maximum pressure of the liquid and (b) will irreversibly "blow out" when the walls 11 of container 10 are squeezed by hand while the container 10 is in any pouring position likely to be encountered in use.

It is desirable that a squeezing of a capped bottle 10, intentionally or as a result of jarring and other motion during shipment, not result in a failure of closure 14. Accordingly, as shown in FIG. 2, it is advantageous that container 10 be fitted with a cap 13 whose upper inner surface engages closure 14 when the cap 13 is attached for storage and shipment. In a preferred embodiment, inner surface 18 of cap 13 is formed to bulge into the opening of mouth 12 and thereby to fit snugly against closure 14. When inner surface 18 of cap 13 engages closure 14, the squeezing of walls 11 of container 10 is unable to exert a differential force on closure 14, thereby preventing closure 14 from being ruptured by such squeezing.

In operation, the user would remove cap 13, rotate container 10 and insert mouth 12 into the aperture of a receptacle, such as an engine crankcase. The user would then squeeze walls 11, which would cause closure 14 to fail, allowing the passage of the liquid in container 10 into the aperture of the receptacle. This is illustrated in FIG. 3, where a closure 14 of the embodiment of FIG. 4 has ruptured along score lines 15, thereby allowing liquid 19 to flow out of mouth 12.

Although preferred embodiments of the invention have been shown and described above, the invention claimed is not so restricted. There may be various modifications to the embodiments which are still within the scope of the invention. For example, container 10 may have various different shapes and mouth 12 may have a different shape or be located on a side of container 10. In addition, cap 13 may be a snap-on cap. There may be other ways to weaken closure 14 which are within the present invention. For example, score 15 of FIG. 4 may instead be a score which slightly penetrates the lower surface of closure 14. The invention is also not limited to containers for engine oil or other lubricants. It is useful for containers for any pourable liquid. Thus, the invention is not to be limited by the specific description above, but should be judged by the claims which follow.

I claim:

1. A container for a liquid, comprising:

(a) a flexible chamber having a mouth with a lip; and (b) a closure for the mouth, said closure being sealed to the lip at the perimeter of the closure and extending over the mouth, said closure including a weakened portion that will retain liquid as the container is rotated into pouring position but will fail irreversibly and release the liquid when the container is squeezed while in pouring position, and in the area of said weakened portion said closure being made substantially of a material which liquifies when immersed in the liquid if the liquid is at least at the temperature of crankcase oil in a normally operating internal combustion engine.

2. A container as in claim 1, wherein said weakened portion comprises a score in, a perforation in, a slit in, or a narrowing of the thickness of said closure.

3. A container as in claim 1, further comprising a cap with an inner top surface which is in contact with substantially all of said closure when the cap is fully secured on said mouth.

4. A closure for sealing the mouth of a flexible container for a liquid, comprising a weakened portion that will retain the liquid as the container is rotated into pouring position but will irreversibly fail and release the liquid when the container is squeezed while in pouring position, and in the area of said weakened portion said closure being made substantially of a material which liquifies when immersed in the liquid if the liquid is at least at the temperature of crankcase oil in a normally operating internal combustion engine.

5. A closure as in claim 4, wherein said weakened portion comprises a score in, a perforation in, a slit in, or a narrowing of the thickness of said closure.

6. A container for a liquid, comprising:

(a) a flexible chamber having a mouth with a lip;

(b) a closure for the mouth, said closure being sealed to the lip at the perimeter of the closure and extending over the mouth;

(c) wherein said closure is slit through such that the closure will retain substantially all of the liquid as the container is rotated into pouring position but will fail irreversibly and release the liquid when the container is squeezed while in pouring position; and (d) wherein a portion of the closure surrounding the score is made substantially of a material which liquifies when immersed in the liquid if the liquid is at least at the temperature of crankcase oil in a normally operating internal combustion engine.

7. A container for a liquid, comprising:

(a) a flexible chamber having a mouth with a lip;

(b) a closure for the mouth, said closure being sealed to the lip at the perimeter of the closure and extending over the mouth;

(c) wherein the closure has a thinned central portion which occupies more than an insubstantial fraction of the area of the closure, the thickness of the thinned central portion being thick enough that the closure will retain liquid as the container is rotated into pouring position but thin enough that the closure will fail irreversibly and release the liquid when the container is squeezed while in pouring position; and (d) wherein said thinned central portion is made substantially of a material which liquifies when immersed in the liquid if the liquid is at least at temperature of crankcase oil in a normally operating internal combustion engine.

8. A closure for sealing the mouth of a flexible container for a liquid, is slit through such that the closure will retain substantially all of the liquid as the container is rotated into pouring position but will fail irreversibly and release the liquid when the container is squeezed while in pouring position, and wherein a portion of the closure surrounding the score is made substantially of a material which liquifies when immersed in the liquid if the liquid is at least the temperature of crankcase oil in a normally operating internal combustion engine.

9. A closure for sealing the mouth of a flexible container for a liquid comprising a thinned central portion which occupies more than an insubstantial fraction of the area of the closure, the thickness of the thinned central portion being thick enough that the closure will retain the liquid as the container is rotated into pouring position but thin enough that the closure will fail irreversibly and release the liquid when the container is squeezed while in a pouring position, and wherein said thinned central portion is made substantially of a material which liquifies when immersed in the liquid if the liquid is at least at the temperature of crankcase oil in a normally operating internal combustion engine.

10. A container for a liquid comprising:

(a) a flexible chamber having a mouth with a lip;

(b) a closure for the mouth, said closure being sealed to the lip at the perimeter of the closure and extending over the mouth, said closure including a weakened portion that will retain liquid as the container is rotated into pouring position but will fail irreversibly and release the liquid when the container is squeezed while in a pouring position;

(c) a cap with an inner top surface which is in contact with substantially all of said closure when the cap is fully secured on said mouth; and (d) wherein said inner top surface is formed to bulge into the opening of the mouth and thereby to fit snugly against the closure.

11. A container as in claim 10, wherein said weakened portion comprises a score in, a perforation in, a slit in, or a narrowing of the thickness of said closure.

12. A container as in claim 10, wherein in the area surrounding said weakened portion the closure is made substantially of a material which liquifies when immersed in the liquid if the liquid is at least at the temperature of crankcase oil in a normally operating internal combustion engine.

* * * * *